US005826557A

United States Patent [19]

Motoyama et al.

[11] Patent Number: 5,826,557

[45] Date of Patent: Oct. 27, 1998

[54] OPERATION CONTROL SYSTEM FOR DIRECT INJECTION 2 CYCLE ENGINE

[75] Inventors: Yu Motoyama; Akihiko Ohokubo, both of Iwata, Japan

[73] Assignee: Yamaha Hatsudoki Kabushiki Kaisha, Iwata, Japan

[21] Appl. No.: 934,531

[22] Filed: Sep. 22, 1997

[30] Foreign Application Priority Data

Sep. 20, 1996 [JP] Japan ..... 8-250573

[51] Int. Cl.[6] ..... F02D 41/00

[52] U.S. Cl. ..... 123/198 F

[58] Field of Search ..... 123/198 F, 73 C, 123/65 PE

[56] References Cited

U.S. PATENT DOCUMENTS 5,408,966 4/1995 Lipinski et al. ..... 123/198 F 5,562,085 10/1996 Kosuda et al. ..... 123/198 F 5,655,508 8/1997 Nonaka ..... 123/683

*Primary Examiner*—David A. Okonsky

*Attorney, Agent, or Firm*—Knobbe, Martens, Olson & Bear LLP

[57] ABSTRACT

A number of embodiments of two-cycle crankcase compression direct injected internal combustion engines wherein engine speed is controlled under at least some running conditions by cylinder disabling. Exhaust systems including exhaust control valves for precluding the passage of cooler gasses from the disabled cylinders to the operating cylinders through their exhaust ports are illustrated in varying forms and for various types of engines.

17 Claims, 10 Drawing Sheets

OPERATION CONTROL SYSTEM FOR DIRECT INJECTION 2 CYCLE ENGINE

BACKGROUND OF THE INVENTION

This invention relates to a control system for engines and more particularly to an improved control system and method for a two-cycle, direct cylinder injected engines.

Because of their high specific output and their relative compact construction, two-cycle engines are widely utilized in a variety of different types of applications. Wherever space is at a premium, a two-cycle engine has obvious advantages because of its aforenoted properties.

A typical example of the utilization of two-cycle engines is in outboard motors. Obviously, the power plan for an outboard motor must be compact and yet produce a fairly high power output. Because of this, the two-cycle engines are widely used in outboard motors and many other forms of marine propulsion systems. The ported nature of the two-cycle engine which gives it a great degree of its simplicity and the fact that a combustion takes place in each cylinder on each revolution of the engine, may cause certain problems to arise. These are primarily in conjunction with exhaust emission control and also with smooth running.

That is, with the two-cycle engine, the expansion and exhaust stroke overlap with the scavenging stroke. That is scavenging gasses flow into the combustion chamber at the same time the exhaust gasses are exiting. Frequently, the scavenging flow is utilized to assist in the extraction of the exhaust gasses. In spite of this advantage, there is also the disadvantage that the exhaust products may contain constituents which are undesirable to the atmosphere.

In order to try to improve the performance of two-cycle engines, direct cylinder injection has been proposed. By injecting the fuel directly into the cylinders, it is possible to more accurately control the amount of fuel and its consumption. However, the direct cylinder injection has certain problems of its own.

First, the time during which the fuel can be injected is relatively short. This requires the use of injectors that can inject with high specific amounts of a fuel in a given time. However, these injectors have trouble providing accurate control of the small amounts of fuel injected at idle and low speeds. This problem is particularly acute with two-cycle marine engines because they are frequently operated for long periods at idle speeds or lower, for example, when trolling.

In order to provide more effective control, particularly in these lower speed ranges, it is therefore a practice to control engine speed by skipping combustion in some cylinders during some cycles. The number of cylinders skipped and number of skipping can be varied in accordance with a wide variety of control strategies.

A problem with this type of system is, however, that the non-firing cylinders have a relatively cool exhaust for obvious reasons. However, this cool exhaust can flow back to other operating cylinders through their exhaust ports and quench the burning occurring therein to deteriorate their combustion.

It is, therefore, a principal object of this invention to provide an improved control system for a direct injected, two-cycle engine.

It is a further object of this invention to provide an improved exhaust control system for a direct injected, two-cycle engine wherein cylinder skipping is employed for controlling running under some ranges, and wherein a protection is provided so that the cooler gasses in the exhaust of the skipped cylinders cannot enter the burning cylinder through their exhaust ports.

SUMMARY OF THE INVENTION

This invention is adapted to be embodied in a multi-cylinder, two-cycle, crankcase compression, internal combustion engine. The engine has at least two combustion chambers in which combustion occurs and each of which is served by a scavenge port and an exhaust port. An exhaust system collects the exhaust gasses from the exhaust ports and delivers it to the atmosphere. A direct cylinder injector is provided for injecting fuel directly into each of the combustion chambers. Under some engine operating conditions, engine speed is controlled by skipping the firing in one or more of the combustion chambers. An exhaust control valve is provided in the exhaust system for precluding the passage of cool gasses from the non-firing combustion chambers from reaching the firing combustion chambers through their exhaust ports.

DETAILED DESCRIPTION OF THE PREFERRED EMBODIMENTS OF THE INVENTION

Figure 1:
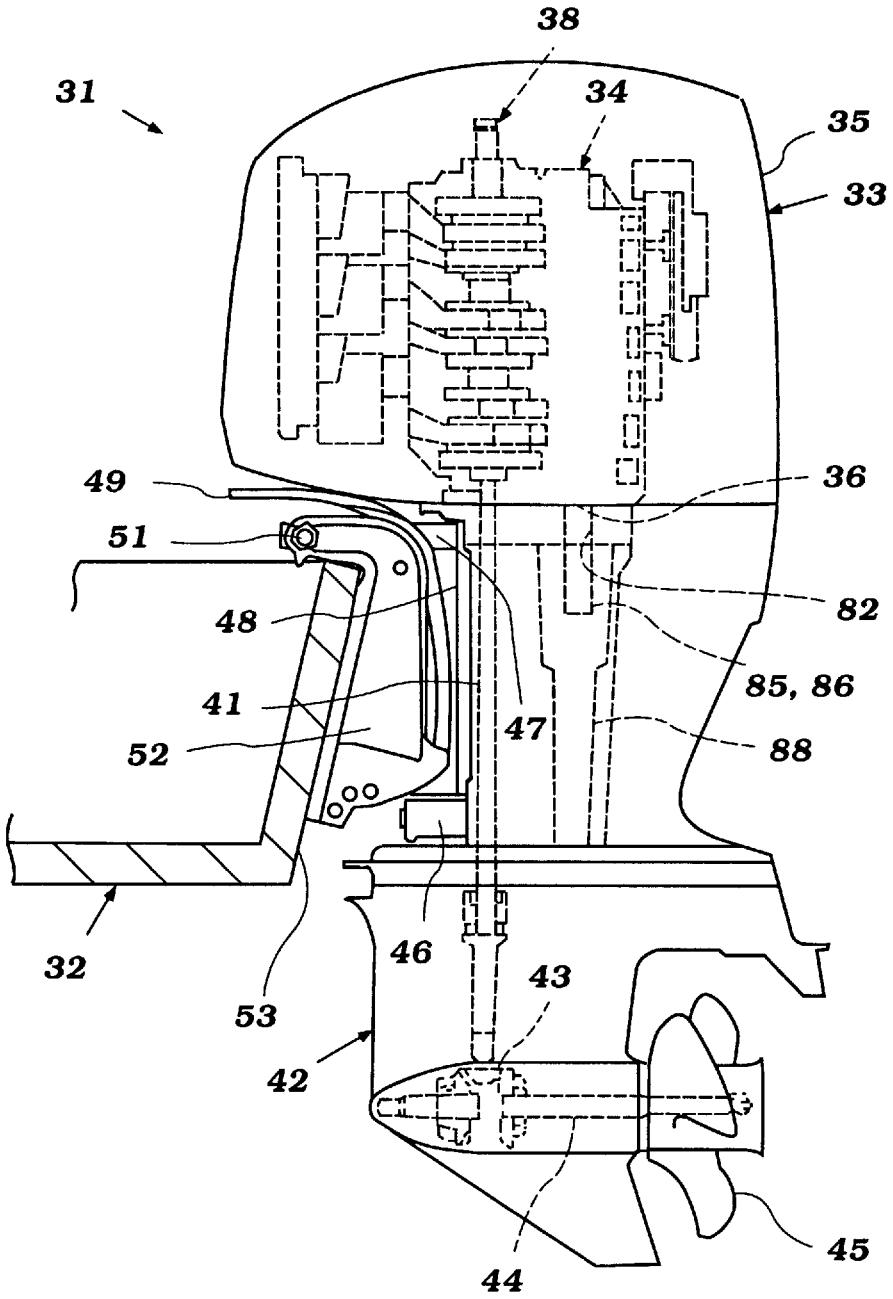
FIG. 1 is a side elevational view of an outboard motor constructed and operated in accordance with an embodiment of the invention, shown attached to the transom of an associated watercraft, which is shown partially and in section.

Referring now in detail to the drawings, and initially to the embodiment of FIG. 1, an outboard motor constructed and operated in accordance with an embodiment of the invention is identified generally by the reference numeral 31. The outboard motor 31 is shown as attached, in a manner to be described, to the transom of a watercraft, indicated generally by the reference numeral 32, and which is shown partially and in cross-section. The invention is described in conjunction with an outboard motor because the invention has particular utility with two-cycle engines, and those engines are frequently employed as the power plants in outboard motors. It will be readily apparent, however, to those skilled in the art how the invention can be utilized in conjunction with other applications for internal combustion engines and particularly two-cycle internal combustion engines.

The outboard motor 31 is comprised of a power head, indicated generally by the reference numeral 33, which includes an internal combustion engine, indicated generally by the reference numeral 34 and which will be described in more detail later by reference to FIGS. 2 and 3. This engine 34 is covered by a protective cowling that is comprised of a main cowling member 35 which is detachably affixed to a tray, identified by the reference numeral 36.

The engine 34 is mounted on an exhaust guide 37 so that its crankshaft 38 rotates about a vertically extending axis. The exhaust guide 37 is disposed at the upper end of a drive shaft housing 39 in which a drive shaft 41 is journaled for rotation in a known manner. The crankshaft 38 is coupled to the drive shaft 41 for driving it in a well-known manner.

This drive shaft 41 depends into a lower unit 42 where it drives a bevel gear, forward, neutral reverse transmission 43. This transmission 43 establishes a driving connection in the desired direction to a propeller shaft 44. The propeller shaft 44 is journaled in a known manner in the lower unit 42, and drives a propeller 45 for propelling the associated watercraft 32.

A steering shaft (not shown) is affixed to the drive shaft housing 39 by means of a lower bracket 46 and an upper bracket 47. This steering shaft is journaled for rotational movement about a vertically extending axis within a swivel bracket 48. As is well known in the outboard motor art, this facilitates steering of the outboard motor 31 by means of a tiller 49 that is affixed to the upper end of the aforenoted steering shaft.

The swivel bracket 48 is, in turn, pivotally connected by means of a pivot pin 51 to a clamping bracket 52. Pivotal movement about the pivot pin 51 permits trim adjustment of the outboard motor 31 and also tilting up of the outboard motor 31 to an out-of-the-water position, as is also well known in this art.

Finally, the clamping bracket 52 includes means to permit detachable connection to a transom 53 of the hull of the watercraft 32.

The structure of the outboard motor 31 as thus far described may be considered to be conventional. As has been previously noted, the invention deals primarily with the engine 34 and the control and operational systems of the engine 34.

The construction of the engine 34 will now be described in more detail, referring primarily to FIGS. 2 and 3. In this embodiment, the engine 34 is depicted as being of the V-6 type. It will be readily apparent, however, to those skilled in the art how the invention may be practiced in conjunction with engines having other cylinder numbers and other cylinder configurations and some of such other arrangements will be described later in more detail. Also, the engine 34 is a two-cycle, crankcase compression engine, inasmuch as the invention has particular utility with such engines.

The engine 34 is comprised of a cylinder block 54 that is formed with a pair of angularly inclined cylinder banks, each of which is formed with three cylinder bores 55. In this embodiment, the cylinder bores 55 are formed by liners that are pressed, cast or otherwise placed in the main cylinder block casting. The main casting is preferably formed from aluminum or an aluminum alloy.

Figure 2:
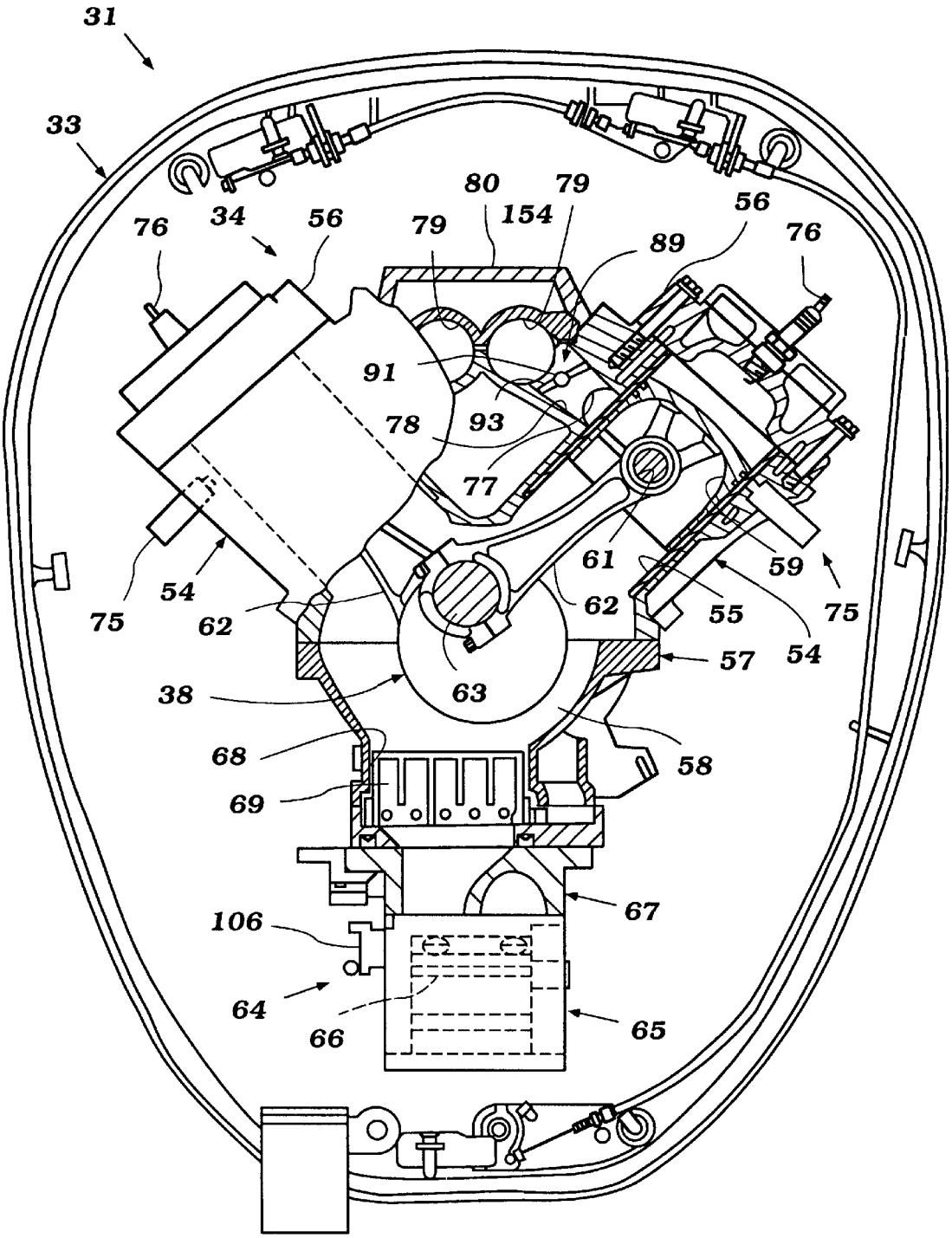
FIG. 2 is a top plan view of the power head of the outboard motor, with the protective cowling main portion removed, and portions of the engine broken away and shown in section.
Figure 3:
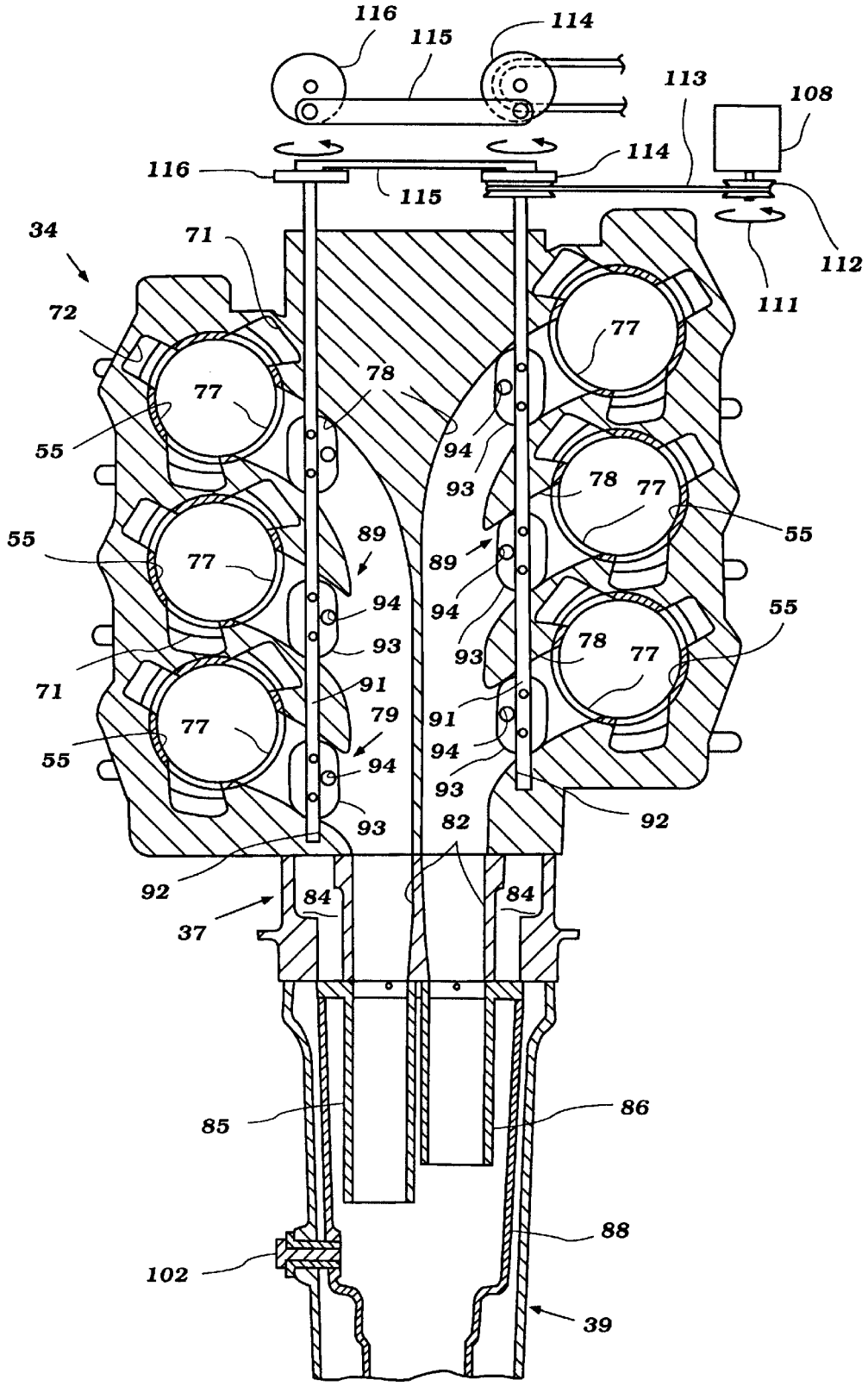
FIG. 3 is a further enlarged cross-sectional view, taken through the cylinder block, showing the upper portion of the exhaust system.

As may be seen in FIGS. 2 and 3, the cylinder bores 55 extend generally horizontally, and those of each bank are spaced vertically from the others. As also shown in FIG. 3, the cylinder bores 55 of the respective cylinder banks are staggered, one from the other, for reasons well known in this art.

One end of the cylinder bores 55 of each cylinder bank is closed by a respective cylinder head assembly 56 that is detachably connected to the respective cylinder block bank in any known manner. The other ends of the cylinder bores are closed by a common crankcase member 57 that is affixed to the skirt of the cylinder block 54. This crankcase member 57 and the cylinder block skirt form a crankcase chamber 58 in which the aforenoted crankshaft 38 is rotatably journaled in a known manner.

Pistons 59 reciprocate in their respective cylinder bores 55. Piston pins 61 pivotally connect the upper or small ends of connecting rods 62 to the pistons 59. The lower or big ends of the connecting rods 62 are journaled on the throws 63 of the crankshaft 38 for driving it in a well-known manner.

As is well known in the two-cycle engine art, the crankcase chamber 58 is divided into individual sealed chambers each associated with a respective one of the cylinder bores 55. An intake air charge is delivered to these crankcase chambers through an air induction system, indicated generally by the reference numeral 64. This air induction system includes an one or more air inlet devices 65 such as throttle bodies which may draw air through an air silencer (not shown) from within the protective cowling 35. Atmospheric air is admitted into the interior of the cowling through an inlet formed in the main cowling member 35. Again, this type of construction is well-known in the art and, for that reason, has not been illustrated.

Figure 7:
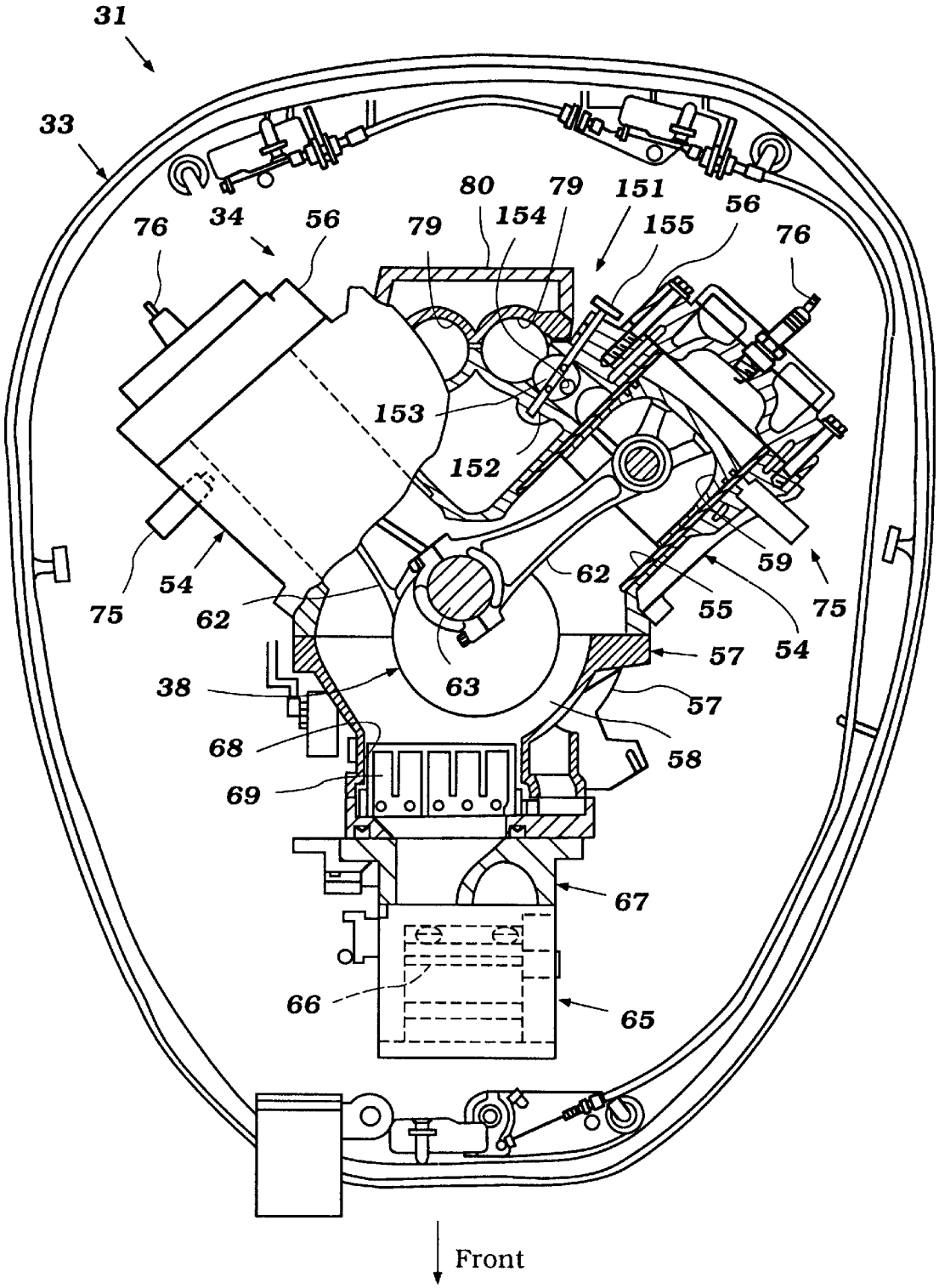
FIG. 7 is a top plan view of the power head of another embodiment of outboard motor, with the protective cowling main portion removed, and portions of the engine broken away and shown in section in part similar to FIG. 2.

Throttle valves 66 are provided in throttle bodies 65. These throttle valves 66 are controlled by a remote operator under operator demand in a manner which will be described. Although this will be described later, the particular system described is a so-called "fly-by-wire" system wherein the operator moves a manual accelerator control and that manual accelerator control position is sensed and the sensed information is sent to an ECU which does a final positioning of the throttle valve 66 in accordance with a control strategy which will be described later. This relationship between the components is also shown in FIG. 7 and will be described in more detail later by reference to that figure.

The throttle bodies 65 deliver their intake air charge to an intake manifold 67 that is sandwiched between them and the crankcase member 57. The passages of the intake manifold 67 feed the individual sealed crankcase chambers 58 through intake ports 68. A reed-type check valve assembly 69 is also sandwiched between the manifold 67 and crankcase member 57. As is well-known in this art, the reed-type valve assembly 69 permits air to flow into the crankcase chambers 58 when the pistons 59 are moving upwardly in their respective cylinder bores.

However, as the pistons 59 move downwardly to compress the air charge in the crankcase chambers 38, the reed-type check valve 69 will close and prevent reverse flow through the intake manifold 67. The charge which is compressed in the crankcase chambers 58 during the aforenoted motion is then transferred to the combustion chamber areas formed above the heads of the pistons 59. This transfer takes place through a pair of side scavenge passages 71 associated with each cylinder and a center scavenge passage 72. These scavenge passages 71 and 72 open into the cylinder bore through scavenge ports 73 formed in the cylinder liners which form the cylinder bores 55.

As may be seen in FIG. 3, these scavenge passages 71 and 72 are staggered slightly around the axes of the cylinder bores 55 so as to permit the cylinder bores 55 to be positioned closer to each other.

At a time after the piston 59 has moved downwardly to compress the charge in the crankcase chambers 58 associated with the respective cylinder, fuel will be injected into the combustion chambers, which are indicated generally by the reference numeral 74 and which are formed primarily by recesses in the cylinder head when the pistons 59 are at their top dead center position. For this purpose, a fuel injector, indicated by the reference numeral 75 is mounted in the cylinder block 54 in a location that is shielded by the piston 59 during the portion of its stroke adjacent top dead center condition, as shown in FIG. 2.

Fuel is supplied to the fuel injectors 75 by a fuel rail which is not shown. Fuel is delivered to this fuel rail by any suitable system that includes a high pressure pump and vapor separator. The pressure is controlled by dumping excess fuel back to the fuel supply system, preferably to the fuel vapor separator. The injection timing is controlled by an electrically solenoid-operated valve which is operated in the sequence and timing as will be described.

Thus, when the charge in the combustion chamber is fired and initial combustion occurs, in a manner which will be described, the fuel injector 75 is protected from the high heat and pressure. However, as the piston 59 continues to move downwardly, then the injector 75 will be exposed. The pressure and temperature will have fallen sufficiently so as to avoid any damage to the injector 75.

Fuel can be injected any time after the piston 59 moves downwardly to expose the injector 75 and terminate any time prior to the fact when the injector 75 is again shrouded by the piston. The fuel injection amount and duration routine is controlled by the control system which will be described shortly.

The fuel/air charge thus present in the combustion chamber when the piston 59 continues its upward movement will be further compressed in the combustion chamber once the scavenge ports 73 are closed.

As the piston 59 approaches its top dead center position and at a timing which is controlled, in a manner which will also be described later, a spark plug 76 mounted in the cylinder head assembly 56 will be fired. This firing is done by an ignition system which will also be described generally later.

As the pistons 59 are driven downwardly by the burning and expansion of the mixture which has been ignited by the firing of the spark plugs 76, eventually a series of exhaust ports 77, one for each cylinder bore 55 will be opened. These exhaust ports 77 are positioned in the cylinder liners and are generally diametrically opposed to the auxiliary scavenge passages 72 and the scavenge port 73 associated therewith.

The exhaust ports 77 communicate with respective exhaust runner passages 78 which form an exhaust manifold 79 that is partially formed within the cylinder block 54 and completed by a cover plate 80. The exhaust manifolds 79 associated with each cylinder bank are separated from each other so that each cylinder bank is, in effect, provided with its own exhaust manifold 79.

These exhaust manifolds 79 have collector sections that communicate with their respective runners and terminate in discharge openings 81 that are formed in the exhaust guide 37. Exhaust passages 82 are formed in the exhaust guide 37 in registry with the exhaust manifold outlets 81.

The exhaust guide 37 is formed with a water jacketing arrangement 83 that receives cooling water from the engine cooling system in a known manner. This cooling arrangement permits the exhaust system to be cooled and assures its good operation. Coolant is delivered to and from the cooling jacket 83 in any suitable manner.

Affixed to the underside of the exhaust guide 37 in any suitable manner are a pair of exhaust pipes 85 and 86, each of which communicates with a respective one of the passages 82 and, accordingly, the exhaust manifolds 79 associated with the respective cylinder banks.

These exhaust pipes 85 and 86 depend into the drive shaft housing 39 and specifically into a silencing expansion chamber 87 formed by an inner shell 88 that is carried by the drive shaft housing 39 in a suitable manner. This inner shell 88 extends downwardly and communicates with a typical underwater exhaust gas discharge for the underwater exhaust discharging and silencing of the exhaust gases flowing from the engine. These types of exhaust systems are well known and also incorporate above the water low-speed exhaust gas discharges, for reasons well known in this art. Since this part of the structure forms no portion of the invention, a further description of it is not believed to be necessary to permit those skilled in the art to practice the invention.

As may be best seen in FIGS. 2 and 3, in accordance with an important feature of the invention, a pair of exhaust control valve assemblies, each indicated generally by the reference numeral 89, are provided in the exhaust system for a purpose which will be described. Each exhaust control valve 89 is comprised of a control valve shaft 91 that is journaled for rotation within the cylinder block 54 in respective drilled or bored openings 92 formed therein. In this embodiment, the control valve shafts 91 pass through the exhaust manifold runner sections 78. In each of these sections, a control valve element 93 is affixed to the control valve shaft 91. Each exhaust control valve 93 is provided with a small opening 94 so that when the valves 93 are in their fully closed positions, as will be described later, they do not completely shut off the runners 79. Again, the reason for this will become apparent later.

The exhaust control valve assemblies 89 are operated by an operating mechanism that will be described in more detail later. In a like manner, the actual control routine for operating the exhaust valves 89 will also be described later.

Before describing the actual control routine, the various components of the engine and their relationship to the associated sensors and control will be described by reference to FIG. 4. As has been previously noted, this control includes an ECU and this is depicted schematically in FIG. 4 and identified by the reference numeral 95. The ECU 95 receives various input signals from sensors associated with the engine. In some instances, a single sensor may provide data which is utilized to determine more than one engine or other condition.

For example, the engine may include a crank angle sensor, indicated by the reference numeral 96 and bearing the legend CA that senses the actual angular position of the engine crankshaft. This same sensor may, by counting pulses in given time periods, be utilized by provide an engine speed signal as indicated by the block 97 (RPM). Alternatively, there may be a pulser for providing an signal for engine speed at a separate crank angle sensor.

As has been noted, the engine 34 is provided with a fly-by-wire system. Thus, there is provided somewhere in the watercraft, such as in the hull 32, an engine operator accelerator control which merely comprises a position sensing device such as a potentiometer, indicated at 98 which gives an indication of the operator demand indicated at ACC.

For cold starting warm up, as well as for other engine controls, there is provided a water temperature or engine temperature sensor, indicated schematically by the block 99. This may be provided by a sensor that goes into the cooling jacket of the engine.

This sensed value is indicated by the legend TW.

As is typical with some control systems for two-cycle engines, there is also provided a crankcase chamber pressure sensor which senses the pressure in the crankcase chamber 58. This sensor is indicated by the block 101 and this signal may be utilized to provide an indication of actual air flow to the engine, as is known in the art.

Figure 4:
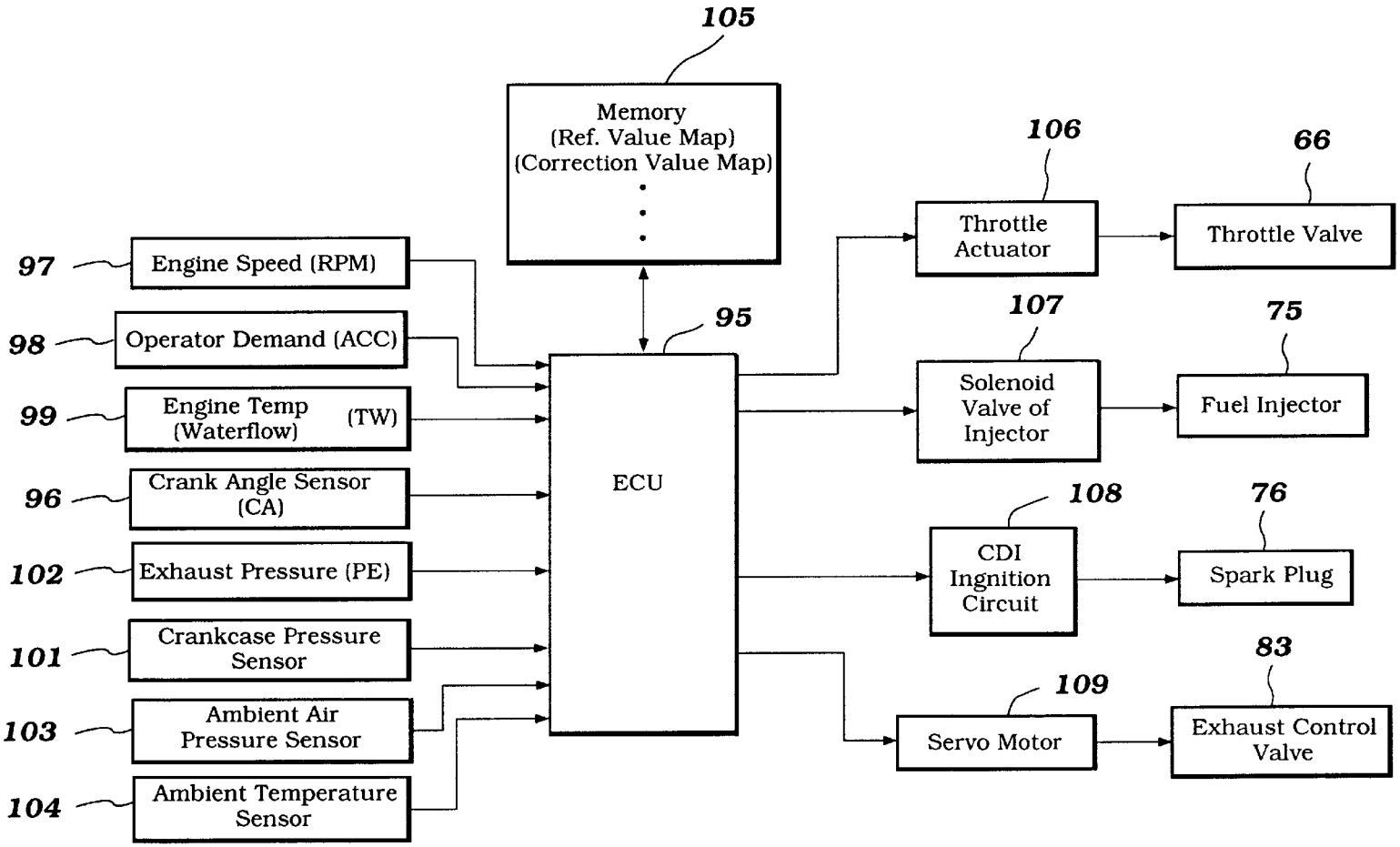
FIG. 4 is a schematic view showing the engine, the sensors and the engine control system.

There is further provided a sensor that senses exhaust back pressure and this sensor is indicated both schematically by the block 102 in FIG. 4 and is illustrated in actuality in FIG. 3. This back pressure sensor senses exhaust pressure PE and protrudes through the drive shaft housing 39 into the inner shell 88 to communicate with the expansion chamber 87.

In addition to the described operator condition sensors, other types of data can be utilized for engine control. However, one of the features of this invention is that it permits the use of a relatively simplified control wherein either operator demand ACC or load and/or engine speed RPM are utilized as the sense variables to provide the main control for the engine under all but certain specific types of running conditions other than normal state running conditions.

Furthermore, certain ambient conditions may be sensed for engine control and two of these sensors are shown at 103 and 104 in block diagram in FIG. 4. These include an ambient air pressure sensor and an ambient air temperature sensor.

Also associated with the ECU is a memory that includes an arrangement for maintaining and memorizing certain data such as a reference value map and a correction value map as will also be described hereinafter. This memory unit is indicated by the block 105.

The ECU 95 utilizes the accumulated and collected data, in a manner which will also be described, and outputs signals for controlling the actual throttle valve 66. The controlled elements illustrated are respectively the throttle valve 66, the fuel injector 75, the spark plugs 76 and the exhaust control valves 89.

The throttle valve 66 is controlled by a throttle actuator 106 which may comprise a stepper motor or servomotor that operates the throttle shaft of the throttle valve 66.

As has been previously noted, the fuel injectors 75 are operated by solenoid control valves and these solenoid valves are indicated schematically by the block 107. The spark plugs 76 are fired by an ignition circuit, represented by the block 108 and which may comprise, for example, a CDI ignition system that is charged and triggered by means that include a magneto generator (not shown) driven off the crankshaft 38.

Finally, the exhaust control valves 89 is operated by a servomotor, indicated schematically at 109 which is coupled to the exhaust control valve shafts 92 by the mechanism shown best at the top of FIG. 3. The servo motor 109, which is rotatable in both forward and reverse directions as indicated by the arrow 111, has affixed to its output shaft a sprocket 112. This sprocket 112 drives a belt 113 which, in turn, drives a first sprocket 114 that is fixed to the upper end of one of the exhaust control valve shafts 91.

A link 115 is connected to the sprocket 114 and also to a corresponding sprocket 116 fixed to the upper end of the remaining exhaust control valve shaft 91. Hence, because of this inter-linked connection, the exhaust control valve shafts 91 will be operated between their closed positions as shown in FIG. 2 to their opened positions as shown in FIG. 3.

Although the term "closed position" is utilized, it will be understood that even when closed and as has been previously noted, the small openings 94 will permit some flow through the exhaust runners 78 and exhaust manifolds 80.

The basic operational control strategy for controlling the various components of the engine such as the timing of firing of the spark plugs 76, the timing and duration of fuel injection from the injector 75 and the position of the throttle valves 66 may be in accordance with any known strategy. However, in accordance with an important feature of the invention, the engine 34 is operated at low and mid-range speeds so as to control the speed by skipping the firing of one or more of the cylinders.

In order to understand this strategy, the cylinders have been numbered, as seen in FIG. 3, by placing a small cylinder number in a circle at the center of each cylinder bore. This is just typical of one type of cylinder and firing order arrangement that may be employed, as will become apparent by description of some of the remaining figures.

In order to maintain good and smooth running, and bearing in mind the trouble in maintaining accurate fuel injection amounts under extremely low speed, low load conditions, the number of cylinders which operate is controlled so that the speed is reduced by reducing the number of cylinders that fire in a given number of cycles. This may be done, as will become apparent, either by skipping one or more cylinders firing each revolution or for one of several revolutions. Various control strategies can be employed in conjunction with this concept several examples of which follow.

As has been previously noted, however, this cylinder skipping can cause poor combustion to result in the remaining, firing combustion chambers. This occurs because of the possibility that the cold or cooler exhaust from the non-firing cylinders can flow back to the firing cylinders through their exhaust runners 78 and exhaust ports 77. Thus, the exhaust control valves 93 are selectively positioned so as to preclude or substantially restrict these reverse flows under these conditions.

Figure 5:
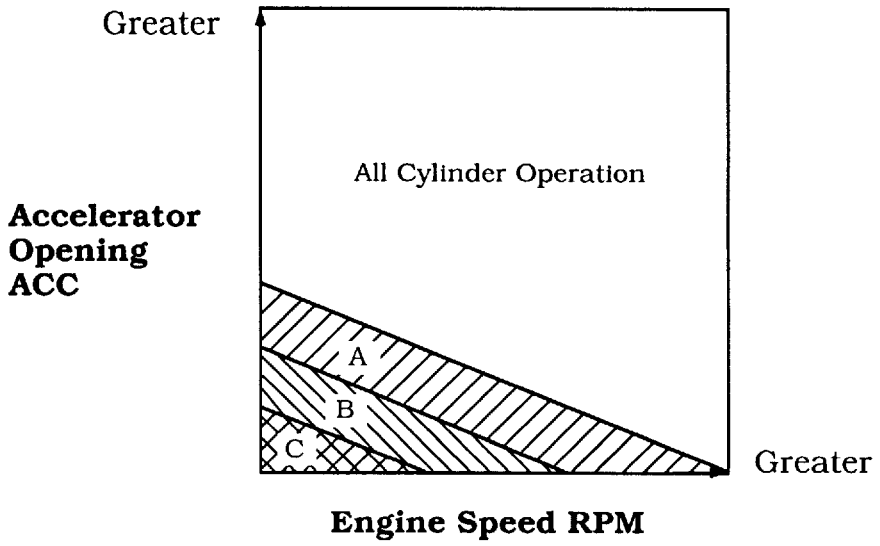
FIG. 5 is a graphical view showing the control range for an engine embodying one form of cylinder skipping wherein alternative skipping patterns are employed depending upon the speed and load conditions.

FIG. 5 is a graphical view showing the control routine in accordance with one range where cylinder disabling is employed in order to control the engine speed. In this routine, there is, in addition to the normal operation where all cylinders operate, three different ranges of cylinder disabling. Cylinder disabling is accomplished either by discontinuing the firing of the spark plug 76 associated with the cylinder to be disabled and/or disabling of the injection of fuel to the cylinder by the fuel injector 75.

It is desirable to discontinue the fuel injection because this will ensure against the wastage of fuel and also will improve exhaust emission control. Regardless of which method is employed, the disabling control, like the basic engine control as aforenoted, is based upon a three-dimensional map utilizing engine speed RPM and operator demands sensed by accelerator opening ACC as basic parameters.

As may be seen, when these values are greater than a predetermined amount, all cylinders are operated. However, as the load and/or speed fall, the control range A is entered. This is a range where one cylinder is disabled approximately every second revolution of the engine with the disabled cylinder being alternated between one cylinder bank and the other. Actually one firing out of ten is skipped. The firing order of the engine is depicted as being 1, 2, 3, 4, 5, 6, and with this control range, the cylinders are disabled with the following pattern, with the disabled cylinder being indicated in a parenthetical expression:

Range A

(1)-2-3-4-5-6-1-2-3-4-(5)-6-1-2-3-4-5-6-1-2-93)-4-5-6-1-2-3-4-5-6-91)-2-3-4-5-6

As the speed and load fall lower into the range B, then the firing is disabled on a more frequent range with the disabling being done once every seven firings in accordance with the following routine:

(1)-2-3-4-5-6-1-(2)-3-4-5-6-1-2-(3)-4-5-6-1-2-3-(4)-5-6-1-2-3-4-(5)-6-1-2-3-4-5-(6)

In the lowest range, the range C, the cylinder firing is interrupted more frequently, once every five firings although this may be done on either regular intervals or on irregular intervals. Thus, either of the following two routines may be utilized:

Range C: Regular Interval Halts

(1-2-3-4-5-(6)-1-2-3-4-(5)-6-1-2-3-(4)-5-6-1-2-(3)-4-5-6-1-(2)-3-4-5-6-(1)-2-3-4-5-(6) Range C: Irregular Interval Halts

(1)-2-3-4-(5)-6-1-2-3-4-(5)-6-1-2-(3)-4-5-6-1-2-(3)-4-5-6-(1)-2-3-4-5-6-(1)-2-3-4-(5)-6

Figure 6:
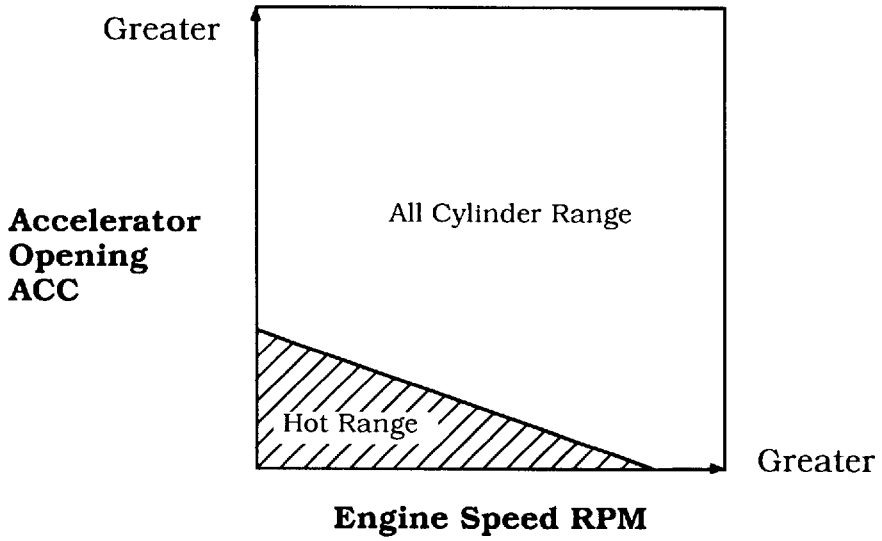
FIG. 6 is a graphical view, in part similar to FIG. 5 and shows another cylinder skipping arrangement.

Alternatively, and as shown in FIG. 6, there may be only one range where cylinder skipping is initiated. Of course, various other arrangements may be utilized to determine how the speed is controlled at the lower end by cylinder disabling on either regular or irregular basis.

Regardless of the method employed, however, when cylinder skipping is initiated, then the exhaust control valve assemblies 89 are moved to their closed position so as to reduce the effective cross-sectional area of the manifold runners 78, and, accordingly, communication between the exhaust from the non-firing cylinders and those which are firing.

Figure 8:
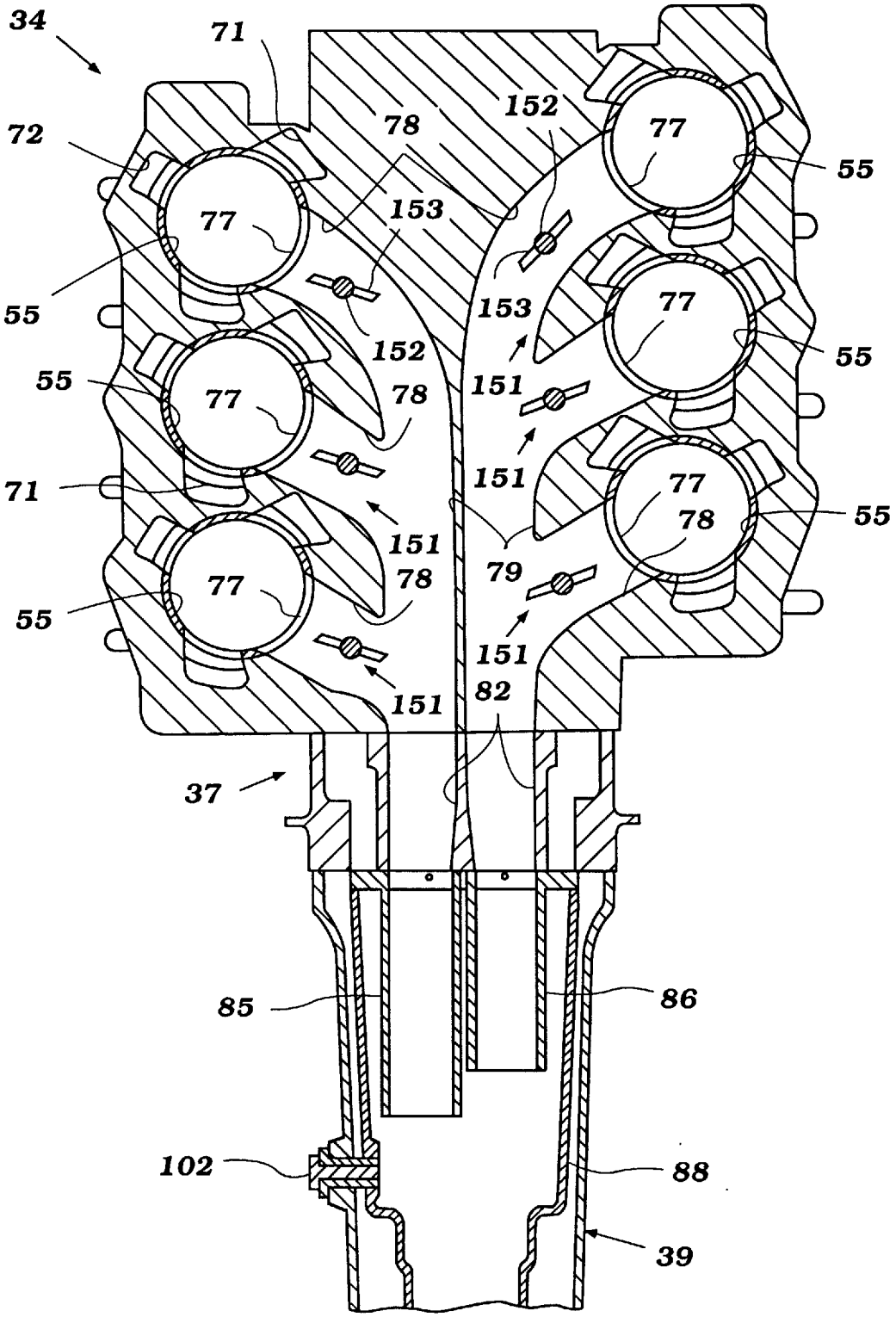
FIG. 8 is an enlarged cross-sectional view of this embodiment, taken through the cylinder block, showing the upper portion of the exhaust system and is, in part, similar to FIG. 3.

In the embodiment of FIGS. 1–4, the exhaust control valves and specifically the valve elements 93 for each cylinder bank have been mounted on a common exhaust control valve shaft 91. FIGS. 7 and 8 show another embodiment wherein each exhaust control valve is mounted on its own shaft and these exhaust control valves are indicated in general by the reference numeral 151. Since this is the only difference from the previous embodiment, portions of the construction which are the same or substantially the same as that already described have been identified by the same reference numeral and will not be described again, except insofar as is necessary to understand the construction and operation of this embodiment.

In this embodiment, each exhaust manifold runner 78 is intersected by a control valve shaft 152 on which a butterfly-type exhaust control valve 153 is fixed. Each valve 153 is formed with a flow opening 154 so as to permit some restricted flow when the valve elements 153 are in their fully closed positions.

Each shaft 152 has affixed to its upper end a control element 155 with the control elements for the valves of each bank being mechanically interconnected with each other and the valves of both banks being driven by a common actuating mechanism, similar to that shown in FIG. 3. In all other regards, this embodiment is the same as that previously described and the method of operation is also the same.

In the embodiments as thus far described, there has been provided an exhaust control valve in each exhaust passage associated with a respective cylinder. In some instances, it may be possible to employ a lesser number of exhaust control valves than cylinders. Where this is done, however, it is preferable to disable only those cylinders which are directly associated with the exhaust control valve. Next will be described a series of embodiments wherein such arrangements are provided.

Figure 9:
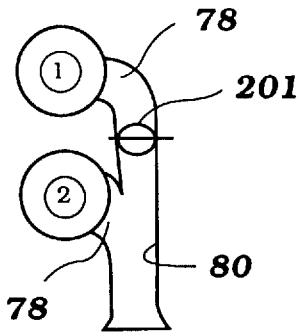
FIG. 9 is a partially schematic view showing the exhaust system of a two cylinder engine constructed in accordance with an embodiment of the invention.
Figure 10:
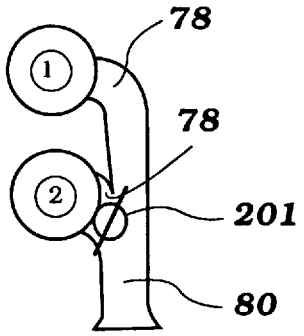
FIG. 10 is a schematic view, in part similar to FIG. 9, and shows another type of exhaust system utilized with another cylinder skipping pattern.

FIGS. 9 and 10 show arrangements wherein there are two cylinders in the engine. This may be an arrangement either with an in-line to cylinder engine, a V-twin or one bank of a V4. In this arrangement, only one cylinder is the disabled in both embodiments of FIGS. 9 and 10.

In the embodiment of FIG. 9, the exhaust control valve, indicated by the reference numeral 201, is positioned in the manifold runner 78 for the cylinder number 1 and upstream of the point where the runner 78 join the common manifold section 80. With this arrangement and as has been noted, only cylinder number 2 should be the disabled cylinder and by closing the exhaust control valve 201 at the time of disabling, will preclude the cool gases from the exhaust port of this cylinder entering the cylinder number 1 when it is filing.

FIG. 10 shows the relationship when only cylinder number 1 is disabled and in this case, the exhaust control valve, again indicated by the reference numeral 201, is positioned in the runner 78 associated with this cylinder and upstream of the common section 80 of the manifold.

Figure 11:
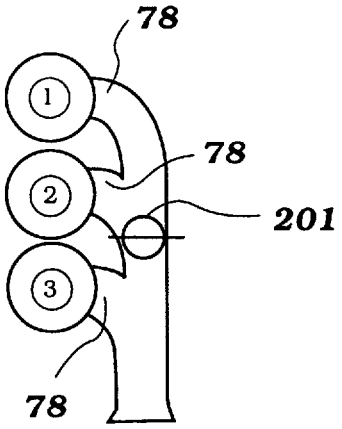
FIG. 11 is a schematic view, in part similar to FIGS. 9 and 10, and shows an embodiment with a three-cylinder in-line engine or which may be utilized with one bank of a six-cylinder engine having angular related cylinder banks.

FIG. 11 shows a three-cylinder arrangement although this also may be one bank of a V6. In this arrangement, cylinder 3 is the cylinder that is disabled and the exhaust control valve 201 is positioned upstream of the runner 78 associated with cylinder number 3 and in the common manifold portion 80 upstream of this cylinder and downstream of cylinders 1 and 2. Hence, by closing the valve 201 when the cylinder 3 is disabled, its cool exhaust gases cannot flow back to cylinders 1 and 2 to interfere with the combustion occurring therein.

Figure 12:
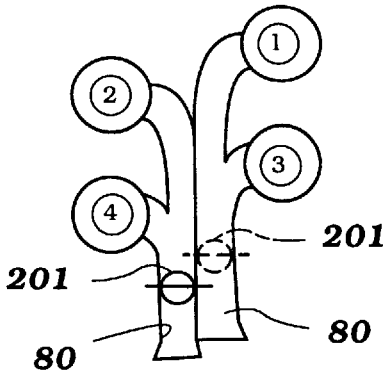
FIG. 12 is a partially schematic view, in part similar to FIGS. 9 through 11, and shows two embodiments of exhaust control systems for four-cylinder V-type engines, one in solid lines and one in phantom lines.
Figure 14:
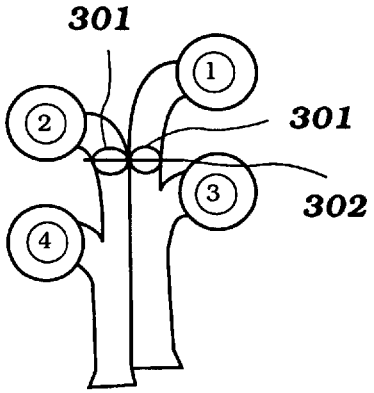
FIG. 14 is a partially schematic view, in part similar to FIGS. 12 and 13, and shows other embodiments of exhaust control for cylinder skipping for V4 engines.
Figure 13:
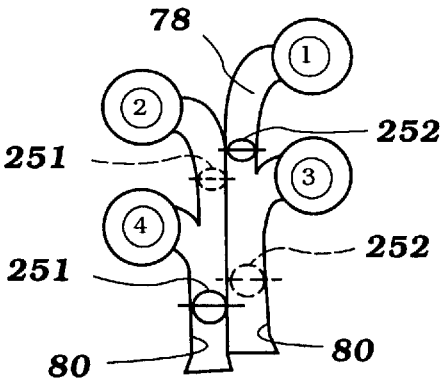
FIG. 13 is a partially schematic view, in part similar to FIG. 12 and shows two other embodiments of control valve arranges for V4 engines, one in solid lines and one in phantom lines.

FIGS. 12–14 show embodiments associated with V4 engines having their cylinders numbered as noted. FIG. 12 shows an arrangement wherein the cylinders 1 and 3 of the right bank are disabled and hence an exhaust control valve shown in solid lines at 201 is disposed in the common manifold section 79 associated with the two cylinders of the left bank (2 and 4). As a result, the cool gases from these cylinders cannot flow back to the manifold section 79 containing the operating cylinders 2 and 4 so as to interfere with their operation.

On the other hand, if cylinders 2 and 4 are the disabled cylinders, then the exhaust control valve 201 should be located in the common section for cylinders 1 and 3, as shown in broken lines, and the valve in the other bank is deleted.

FIG. 13 shows another embodiment wherein only the cylinder number 3 is the cylinder that is skipped or not fired. As a result, a control valve 251 is positioned in the manifold 80 downstream from the bank of cylinders containing the cylinders 2 and 4, and a second valve 252 is positioned in the runner 78 of cylinder 1 so as to isolate it from the non-firing cylinder 3.

The phantom line valve position show an arrangement that will be utilized if it is the cylinder number 4 which is skipped.

FIG. 14 shows an arrangement wherein two exhaust control valves 301 may be affixed to a common valve shaft 302 that spans the cylinder banks between cylinders 1 and 3, and 2 and 4, respectively. With such an arrangement, cylinders 3 and 4 would be those cylinders which are disabled or skipped. Thus, by closing the valves 301, it is possible to prevent the gases flowing from the cool gases from the cylinders 3 and 4 to flow into cylinders 1 and 2.

Figure 15:
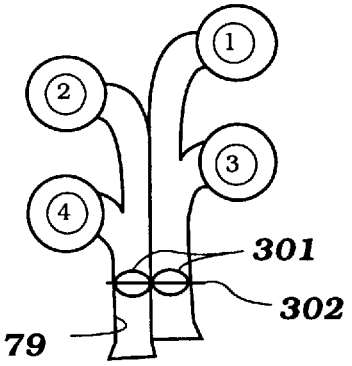
FIG. 15 is a partially schematic view, in part similar to FIGS. 12 through 14, and shows yet another embodiment of V4 type engine.

FIG. 15 shows another arrangement using a common valve shaft, but in this case the valves are placed in the downstream ends of the manifolds 80. This system is useful when both cylinders in the same bank are halted from firing.

FIGS. 16–20 show a number of embodiments applied to V6 engines. Each of these embodiments also utilizes only two exhaust control valves and they may either be mounted on the same shaft, in which case the valves have been indicated by the reference numerals 301 and the shaft by the reference numeral 302. Alternatively, a separate valve may be employed in each bank and in that case, the valves are indicated by the reference numerals 251 and 252, respectively.

Figure 16:
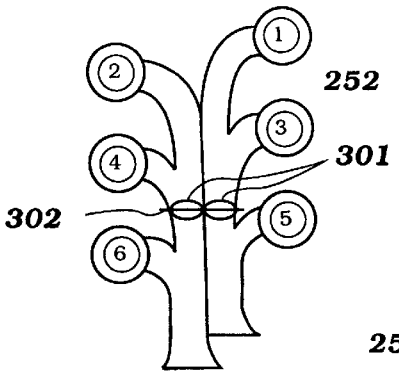
FIG. 16 is a partially schematic view showing another embodiment of V6 engines.

FIG. 16 shows the arrangement that would be utilized if cylinders 5 and 6 are the skipped cylinders.

Figure 17:
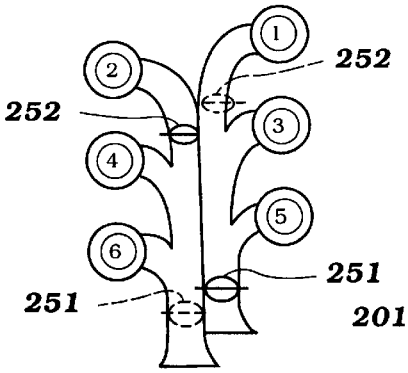
FIG. 17 is a partially schematic view, in part similar to FIG. 16, and shows two other embodiments V6 engines, one in solid lines and one in phantom lines.

FIG. 17 shows, in solid line, the arrangement where cylinders 4 and 6 of the left bank are skipped. The phantom line view shows an arrangement where cylinders 3 and 5 of the right bank are skipped.

Figure 18:
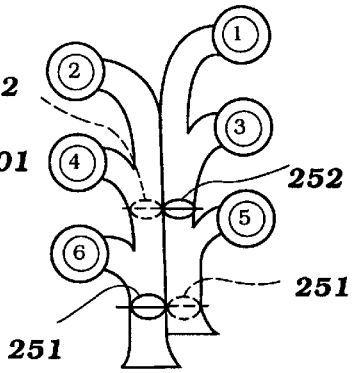
FIG. 18 is a partially schematic view, in part similar to FIGS. 16 and 17, and shows two additional embodiments of V6 exhaust systems, one in solid lines and one in phantom lines.

FIG. 18 shows in solid lines an arrangement where the skipped cylinder is cylinder number 5. The phantom line position shows the arrangement where the skipped cylinder is cylinder number 6.

Figure 19:
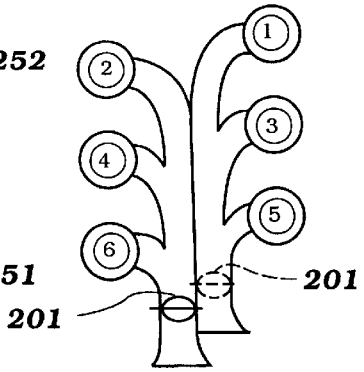
FIG. 19 is a partially schematic view, in part similar to FIGS. 16 through 18 and shows two additional embodiments of V6 engines, one in solid lines and one in phantom lines.

FIG. 19 shows an arrangement in solid lines where any one or all of the cylinders 1, 3 and 5 are the skipped cylinders. The phantom line view shows an arrangement wherein any one or all of the cylinders 2, 4 and 6 are the skipped cylinders.

Figure 20:
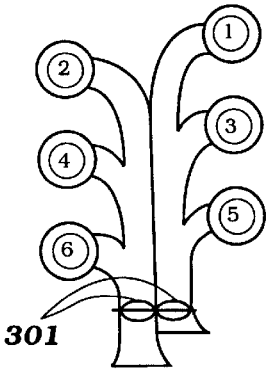
FIG. 20 is a partially schematic view, in part similar to FIGS. 16 through 19 and shows another embodiment of the invention.

FIG. 20 shows an arrangement wherein the valves 301 are on a common shaft 302 and at the downstream ends of both manifold sections so that the cylinders of either bank may be skipped.

Of course, the foregoing description is that of preferred embodiments of the invention. It will be readily apparent to those skilled in the art how various changes and modifications may be made without departing from the spirit and scope of the invention, as defined by the appended claims.

What is claimed is:

1. A multiple cylinder, two-cycle, crankcase compression, internal combustion engine comprised of an engine body defining at least two combustion chambers, a crankcase chamber associated with each of said combustion chambers, scavenge passage means extending from said crankcase chamber to the respective of said combustion chambers and communicating therewith through a scavenge port opened and closed by a piston reciprocating in the respective combustion chamber, an exhaust port formed in each of said combustion chambers and opened and closed by the reciprocation of said piston for discharging exhaust gasses therefrom, an exhaust system for discharging exhaust gasses from said exhaust ports to the atmosphere comprised of an exhaust manifold having a plurality of branch passages, each extending from a respective one of said exhaust ports to a common collector section, said common collection section communicating with the atmosphere, combustion control means for delivering and igniting a combustible charge in each of said combustion chambers, means for controlling the speed of said engine during at least one running range by periodically disabling the combustion in at least one of said combustion chambers, exhaust control valve means in said exhaust system for controlling the effective flow area therethrough, means for controlling the position of said exhaust control valve means during cylinder disabling for precluding cooler gasses from the disabled combustion chamber from entering an operating combustion chamber through its exhaust port.

2. A multiple cylinder, two-cycle, crankcase compression, internal combustion engine as set forth in claim 1, wherein the exhaust control valve means includes at least one exhaust control valve interposed in a branch passage of said exhaust system.

3. A multiple cylinder, two-cycle, crankcase compression, internal combustion engine as set forth in claim 2, wherein the exhaust control valve is positioned in a branch passage of a combustion chamber that is not disabled.

4. A multiple cylinder, two-cycle, crankcase compression, internal combustion engine as set forth in claim 3, wherein there is an exhaust control valve in all of the branch passages of the exhaust manifold.

5. A multiple cylinder, two-cycle, crankcase compression, internal combustion engine as set forth in claim 3, wherein there are no exhaust control valves in the branch passages of those combustion chambers that are disabled.

6. A multiple cylinder, two-cycle, crankcase compression, internal combustion engine as set forth in claim 1, further including means for determining another engine operational condition than combustion chamber disabling and for controlling the position of the exhaust control valve means in response to at least one sensed engine running condition in that other operational condition.

7. A multiple cylinder, two-cycle, crankcase compression, internal combustion engine as set forth in claim 4, wherein the exhaust control valve is more fully closed during cylinder disabling than during the operational condition when combustion chamber disabling is not practiced.

8. A multiple cylinder, two-cycle, crankcase compression, internal combustion engine as set forth in claim 1, wherein the combustion control means includes a plurality of fuel injectors, each injecting fuel directly into a respective combustion chamber.

9. A multiple cylinder, two-cycle, crankcase compression, internal combustion engine as set forth in claim 6, wherein the fuel injectors are covered during at least a portion of the stroke of the piston.

10. A multiple cylinder, two-cycle, crankcase compression, internal combustion engine as set forth in claim 9, wherein the exhaust control valve means includes at least one exhaust control valve interposed in a branch passage of said exhaust system.

11. A multiple cylinder, two-cycle, crankcase compression, internal combustion engine as set forth in claim 10, wherein the exhaust control valve is positioned in a branch passage of a combustion chamber that is not disabled.

12. A multiple cylinder, two-cycle, crankcase compression, internal combustion engine as set forth in claim 11, wherein there is an exhaust control valve in all of the branch passages of the exhaust manifold.

13. A multiple cylinder, two-cycle, crankcase compression, internal combustion engine as set forth in claim 11, wherein there are no exhaust control valves in the branch passages of those combustion chambers that are disabled.

14. A multiple cylinder, two-cycle, crankcase compression, internal combustion engine as set forth in claim 10, further including means for determining another engine operational condition than combustion chamber disabling and for controlling the position of the exhaust control valve means in response to at least one sensed engine running condition in that other operational condition.

15. A multiple cylinder, two-cycle, crankcase compression, internal combustion engine as set forth in claim 14, wherein the exhaust control valve is more fully closed during cylinder disabling than during the operational condition when combustion chamber disabling is not practiced.

16. A method of operating a cylinder, two-cycle, crankcase compression, internal combustion engine comprised of an engine body defining at least two combustion chambers, a crankcase chamber associated with each of said combustion chambers, scavenge passage means extending from said crankcase chamber to the respective of said combustion chambers and communicating therewith through a scavenge port opened and closed by a piston reciprocating in the respective combustion chamber, an exhaust port formed in each of said combustion chambers and opened and closed by the reciprocation of said piston for discharging exhaust gasses therefrom, an exhaust system for discharging exhaust gasses from said exhaust ports to the atmosphere comprised of an exhaust manifold having a plurality of branch passages, each extending from a respective one of said exhaust ports to a common collector section, said common collection section communicating with the atmosphere, said method comprising the steps of delivering and igniting a combustible charge in each of said combustion chambers, controlling the speed of said engine during at least one operational running range by periodically disabling the combustion in at least one of said combustion chambers, and controlling the flow of exhaust gasses during cylinder disabling for precluding cooler gasses from the disabled combustion chamber from entering an operating combustion chamber through its exhaust port.

17. A method of operating a cylinder, two-cycle, crankcase compression, internal combustion engine as set forth in claim 16, further including the step of determining another engine operational condition than combustion chamber disabling and controlling the position of the exhaust gas flow in response to at least one sensed engine running condition in that other operational condition.

* * * * *